United States Patent [19]

Holmgren

[11] Patent Number: 5,005,795

[45] Date of Patent: Apr. 9, 1991

[54] MULTIPURPOSE EASEL

[76] Inventor: Steven A. Holmgren, 703 N. Ella Ave., Sandpoint, Id. 83864

[21] Appl. No.: 531,632

[22] Filed: Jun. 1, 1990

[51] Int. Cl.[5] ..... A47B 97/04

[52] U.S. Cl. ..... 248/449; 248/455; 248/465

[58] Field of Search ..... 248/441.1, 449, 454, 248/455, 463, 464, 465; 108/10, 118; 403/80, 108, 381

[56] References Cited

U.S. PATENT DOCUMENTS 4,125,338 11/1978 Lew ..... 403/381 X 4,482,185 11/1984 Zoellner ..... 248/455 X

*Primary Examiner*—Carl D. Friedman

*Assistant Examiner*—Derek J. Berger

*Attorney, Agent, or Firm*—James D. Givnan, Jr.

[57] ABSTRACT

An easel having a pair of segmented front legs and a segmented rear leg member with the legs and segments slidably joined by dovetails and dovetail grooves for varying easel height. The front leg segments, in addition to being extensible, are pivotally joined to the main members of the legs to permit angular positioning of the front leg segments to the vertical to serve as the front legs of the drafting table configuration. In this configuration, the upper ends of the main members are positioned downwardly along the rear leg member to provide a sloping, workpiece supporting surface in the nature of a drafting board. A detachable cross member serves to brace the vertical front leg segments against swaying while a brace assembly braces the connection between the main leg members and the rear leg member.

4 Claims, 2 Drawing Sheets

MULTIPURPOSE EASEL

BACKGROUND OF THE INVENTION

The present invention pertains to easels of the type used by draftsmen, artists, store displays, etc.,.

Known easels typically are tripods with the legs joined at an apex and with a support for the article in place thereon. Such easels are normally of a single configuration and do not permit use as a drafting table.

In the prior art, U.S. Pat. No. 3,512,486 shows an easel having a hinged segment to permit it to be used as an ironing board as well as a drawing board. U.S. Pat. No. 1,286,018 shows an easel with a tiltable platform on which an article may be supported in an upright manner or sloped for drafting. U.S. Pat. No. 3,538,318 discloses an easel having telescopic legs while the easel in U.S. Pat. No. 3,199,825 has collapsible legs for stowage purposes.

SUMMARY OF THE PRESENT INVENTION

The present invention is embodied in an easel with extensible leg member segments some of which may be pivoted to the vertical to serve as front legs of a drafting table.

The leg members of the present easel are of the extensible type with a front pair of legs having extensible segments which may also be pivotally repositioned about a horizontal axis into angular relationship with the leg member proper i.e., the main portion of the leg member to serve as legs of a drafting table. A support for a workpiece is positionable on the front leg members both in easel and in drafting table configurations. An anti sway cross member is positionable between the front leg segments and held in place in a readily detachable manner as by a strap, for example. The rear leg of the easel has a slotted upper portion to permit attachment of the ends of the front leg members both in the easel and drafting table configurations.

Important objectives include the provision of an easel which may be readily converted to a drafting table with a work surface adjustable about a range of adjustments; the provision of a multipurpose, knockdown easel which lends itself to being stowed in a compact manner; the provision of a multipurpose easel adapted to support a wide range of different sized workpieces at different inclinations and heights above a floor surface.

DETAILED DESCRIPTION OF THE PREFERRED EMBODIMENTS

Figure 1:
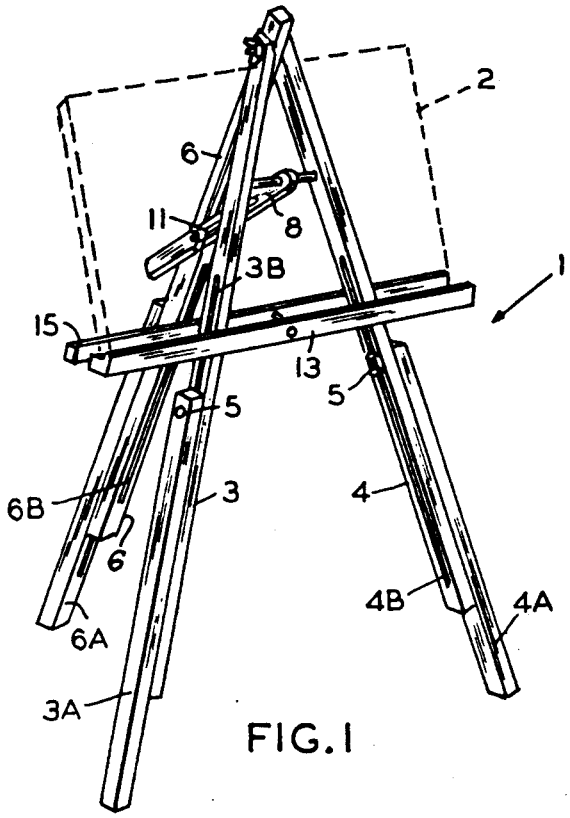
FIG. 1 is a perspective view of the present easel.
Figure 2:
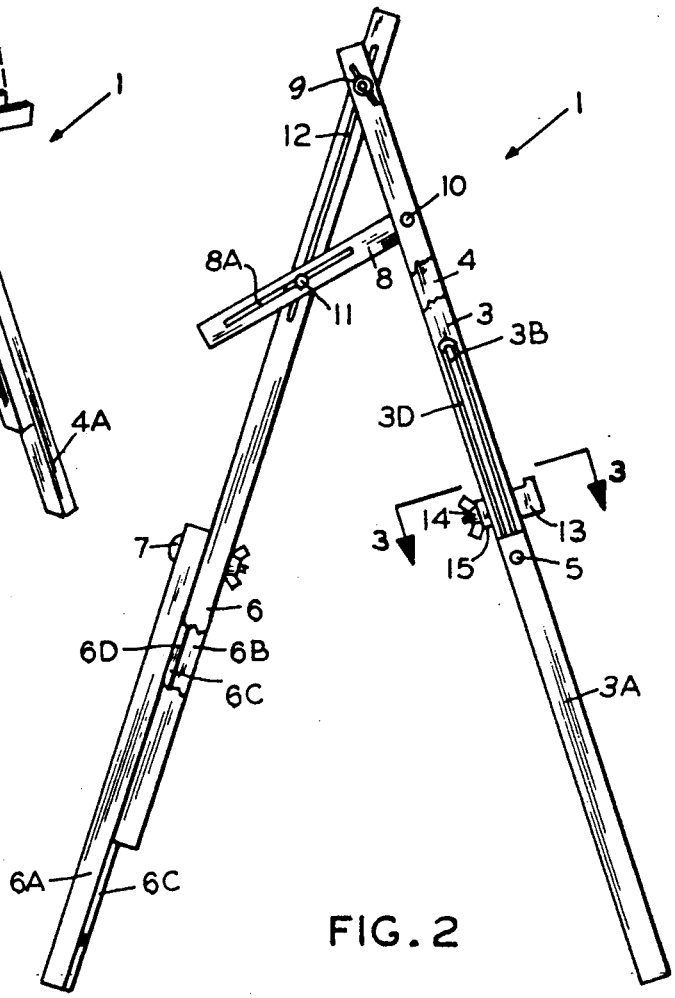
FIG. 2 is a side elevational view taken from the left side of FIG. 1.
Figure 4:
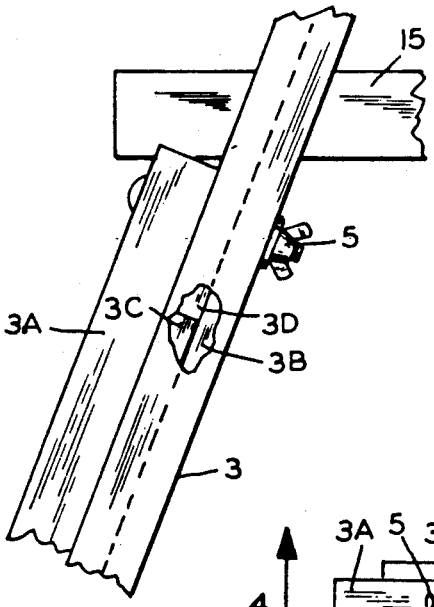
FIG. 4 is a vertical sectional view taken along line 4—4 of FIG. 3.
Figure 3:
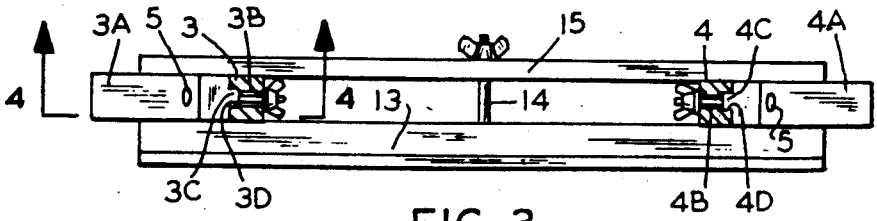
FIG. 3 is a horizontal sectional view taken downwardly along line 3—3 of FIG. 2.

With continuing attention to the drawings wherein applied reference numerals indicate parts similarly hereinafter identified, the reference numeral 1 indicates generally the present multipurpose tripodal easel supporting a workpiece at 2 shown in phantom lines. A pair of front leg members at 3 and 4 each include an extensible segment 3A and 4A each provided at their upper ends with a bolt and wing nut as at 5 extending through slots 3B and 4B in the leg members. The front leg extensible segments each include a lengthwise dovetail 3C–4C terminating in spaced relationship to the upper end of the extensible segments as per FIG. 4. Dovetail grooves are at 3D–4D in the extensible leg segments.

A rear leg member 6 is slotted at 6B to receive a fastener assembly 7 positionable along the slot during positioning of an extensible rear leg segment 6A. A lengthwise extending dovetail is at 6C received in a dovetail groove 6D in leg member 6. Accordingly, upon loosening of the front leg fastener assemblies 5 and the rear leg fastener assembly 7, the downwardly extensible leg segments 3A, 4A and 6A may be adjusted to determine easel height.

A brace assembly includes a brace 8 and a dowel 10 which extends through one end of the brace and through aligned openings in front legs 3 and 4. A slot 8A in the brace 8 receives a fastener assembly 11 which also extends through a slot 12 in the upper portion of rear leg member 6.

For supporting a workpiece, as at 2, a horizontal support 13 is clamped against the front legs by means of a fastener 14 extending therethrough and through a cooperating support member 15.

Figure 5:
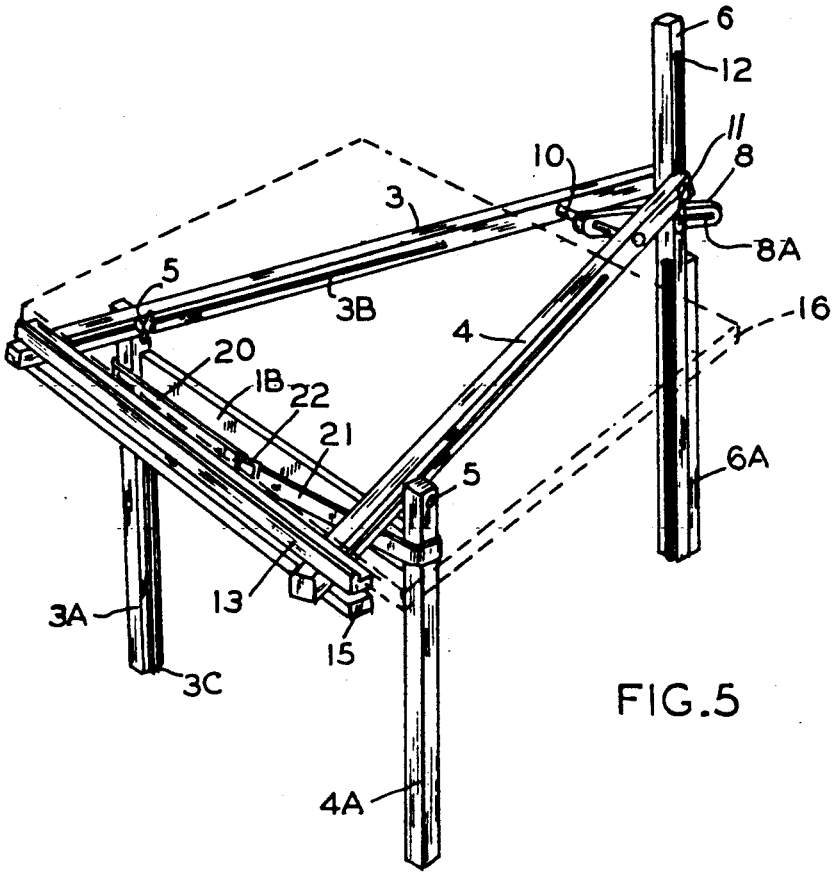
FIG. 5 is a perspective view of the present easel reconfigured as a drafting table.
Figure 6:
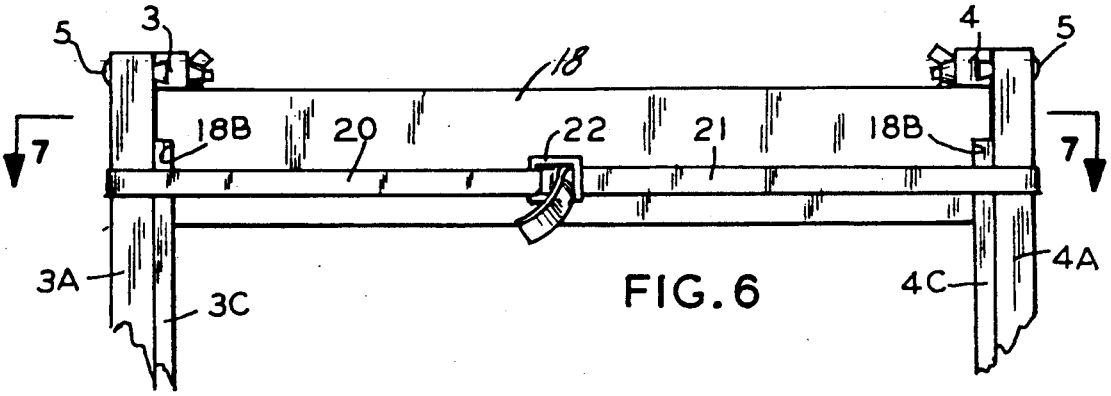
FIG. 6 is a fragmentary front elevational view taken of the drafting table shown in FIG. 5.

In the drafting table configuration, as shown in FIG. 5, the leg segments have been positioned into angular relationship with their main leg members. Such downward positioning of the extensible segments 3A–4A is permitted by the segments also being pivotally mounted on their respective main members by fastener assemblies 5. The dovetail 3C and 4C terminate inward from the upper ends of their respective leg segments to permit pivotal movement of the latter when fully extended.

The rear leg member 6 is shortened by retraction of its leg segment 6A. Further, the apex of the front leg members 3 and 4 along with fastener assembly 9 are positionable downwardly along a slot 12 in the rear leg member to provide the desired slope or inclination to legs 3 and 4 which now serve to support a workpiece 16 shown in phantom lines.

Figure 7:
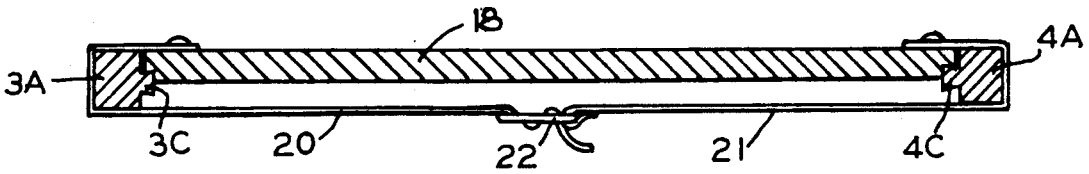
FIG. 7 is a horizontal sectional view taken downwardly along line 7—7 of FIG. 6.

With continuing attention to FIG. 5, it will be seen that the support 13 has been positioned adjacent the spaced apart ends of the front leg members 3 and 4 to confine a platform or workpiece 16 in place on the drafting table. To provide rigidity to the now vertical leg segments 3A–4A, a cross member 18 is now inserted therebetween. The cross member has recessed ends at 18A and 18B to receive the upper ends of the dovetails 3C and 4C on leg segments 3A and 4A. Accordingly, cross member 18 is in rested engagement with the extensible leg segments and is held in engagement therewith by straps 20 and 21 which, as shown in FIG. 7, are attached to one of their ends to the cross member and extend outwardly therefrom about the lower leg segments and thence inwardly for joining by a buckle 22.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A tripodal easel convertible into a tripodal drafting table and comprising, an upright pair of front leg members and an upright rear leg member each including a downwardly extensible segment, said rear leg member slotted for that portion if its length adjacent it upper end, fastener means attaching the upper ends of said front leg members to said rear leg member in an adjustable manner permitting the attached upper ends of the front leg members to be positioned at different distances from the upper end of said rear leg member, a brace assembly adjustably coupling said front leg members to said rear leg member, and adjustable coupling means including fastener assemblies each joining each said downwardly extensible segment of each front leg member to the front leg member in a manner permitting downward extension and locking in place of each extensible leg segment, said coupling means additionally permitting each extensible leg segment to be angularly displaceable about one of said fastener assemblies to an upright position to serve as a drafting table leg while the remaining portion of each front leg member serves as a workpiece supporting table top.

2. The easel claimed in claim 1 wherein said adjustable coupling means includes dovetails and dovetail shaped grooves, said front leg members each additionally defining a slot to receive one of said fastener assemblies, said dovetails removable from said dovetail grooves to permit angular displacement of said extensible leg segment to said upright position.

3. The easel claimed in claim 2 wherein said rear leg member and its downwardly extensible segment include a coupling means including a dovetail and a dovetail shaped groove.

4. The easel claimed in claim 1 additionally including a cross member in rested engagement with said front leg members to brace the leg members, straps on said cross member each extending outwardly therefrom for passage about the extensible segment of each front leg member and thence inwardly therefrom for buckling to one another.

* * * * *